US009846391B2

(12) United States Patent
Sasaki

(10) Patent No.: US 9,846,391 B2
(45) Date of Patent: Dec. 19, 2017

(54) DEVELOPING DEVICE REPLENISHED WITH NEW TWO-COMPONENT DEVELOPER WHILE DISCHARGING SURPLUS DEVELOPER AND IMAGE FORMING APPARATUS THEREWITH

(71) Applicant: KYOCERA Document Solutions Inc., Osaka (JP)

(72) Inventor: Yu Sasaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/295,314

(22) Filed: Oct. 17, 2016

(65) Prior Publication Data

US 2017/0176890 A1 Jun. 22, 2017

(30) Foreign Application Priority Data

Dec. 17, 2015 (JP) ..... 2015-245824

(51) Int. Cl.
*G03G 15/08* (2006.01)

(52) U.S. Cl.
CPC ..... *G03G 15/0893* (2013.01); *G03G 15/0889* (2013.01); *G03G 15/0891* (2013.01);
(Continued)

(58) Field of Classification Search
CPC ..... G03G 15/0889; G03G 15/0891; G03G 15/0893; G03G 2215/0822; G03G 2215/083; G03G 2215/0838
(Continued)

(56) References Cited

U.S. PATENT DOCUMENTS 7,493,069 B2 * 2/2009 Akedo ..... G03G 15/0893 399/254
8,412,077 B2 * 4/2013 Ishiguro ..... G03G 15/0853 399/254
(Continued)

FOREIGN PATENT DOCUMENTS

JP 10026878 A * 1/1998
JP 2009251555 A * 10/2009 ..... G03G 15/0822
(Continued)

*Primary Examiner* — Robert Beatty
(74) *Attorney, Agent, or Firm* — Stein IP, LLC

(57) ABSTRACT

A developing device has a developer container, a first stirring/transporting member, a second stirring/transporting member, a developer carrying member, a developer supply port, a developer discharge port, a regulating portion, and a height adjustment opening. The developer container has a partition partitioning between first and second transport chambers, and communication portions through which the first and second transport chambers mutually communicate. The first and second stirring/transporting members stir and transport developer in the first and second transport chambers in opposite directions respectively. The regulating portion regulates movement of the developer toward a developer discharge port. The height adjustment opening is formed in the partition, and when the height of the developer in the second transport chamber is equal to or higher than a predetermined height, part of the developer passes through the height adjustment opening and moves to the first transport chamber.

5 Claims, 6 Drawing Sheets

(52) U.S. Cl.
CPC ..... *G03G 2215/0822* (2013.01); *G03G 2215/0838* (2013.01)

(58) Field of Classification Search
USPC ..... 399/254, 256
See application file for complete search history.

(56) References Cited

U.S. PATENT DOCUMENTS

| | | | | |
|---|---|---|---|---|
| 8,611,797 | B2 * | 12/2013 | Maeda | G03G 15/0893 399/254 |
| 2006/0204283 | A1 * | 9/2006 | Yasuda | G03G 15/0877 399/254 |
| 2007/0223944 | A1 * | 9/2007 | Mizuta | G03G 15/0893 399/27 |
| 2008/0025762 | A1 * | 1/2008 | Takayama | G03G 15/0893 399/254 |
| 2009/0214266 | A1 * | 8/2009 | Kato | G03G 15/0893 399/254 |
| 2011/0052265 | A1 * | 3/2011 | Kim | G03G 15/0832 399/254 |
| 2012/0177412 | A1 * | 7/2012 | Watanabe | G03G 15/0189 399/256 |
| 2015/0003848 | A1 * | 1/2015 | Sakaya | G03G 15/0831 399/27 |
| 2015/0003876 | A1 | 1/2015 | Iida et al. | 399/254 |
| 2016/0216639 | A1 * | 7/2016 | Nose | G03G 15/0886 |

FOREIGN PATENT DOCUMENTS

| | | | |
|---|---|---|---|
| JP | 2011237659 | A * | 11/2011 |
| JP | 2015-11158 | A | 1/2015 |

* cited by examiner

DEVELOPING DEVICE REPLENISHED WITH NEW TWO-COMPONENT DEVELOPER WHILE DISCHARGING SURPLUS DEVELOPER AND IMAGE FORMING APPARATUS THEREWITH

INCORPORATION BY REFERENCE

This application is based upon and claims the benefit of priority from the corresponding Japanese Patent Application No. 2015-245824 filed on Dec. 17, 2015, the entire contents of which are incorporated herein by reference.

BACKGROUND

The present disclosure relates to a developing device incorporated in an image forming apparatus exploiting electrophotography, such as a copier, a printer, a facsimile machine, or a multifunction peripheral thereof, and to an image forming apparatus incorporating the developing device. More particularly, the present disclosure relates to a developing device which can be replenished with new two-component developer containing toner and carrier and meanwhile discharge surplus developer, and to an image forming apparatus incorporating such a developing device.

In an image forming apparatus, an electrostatic latent image formed on an image carrying member comprising a photosensitive member or the like is made visible by being developed into a toner image by a developing device. Some such developing devices adopt a two-component developing system that uses two-component developer. In this type of developing device, two-component developer containing carrier and toner is stored in a developer container, a developing roller is arranged for feeding the developer to the image carrying member, and a stirring member is arranged for feeding, while stirring and transporting, the developer in the developer container to the developing roller.

In a developing device adopting a two-component developing system, toner is consumed in developing operation, whereas carrier is left unconsumed in the developing device. Thus, carrier stirred together with toner inside the developer container deteriorates under mechanical stress as the carrier is stirred repeatedly, gradually diminishing the toner charging performance of the carrier.

As a solution, developing devices have been proposed that supply fresh developer containing carrier and toner into a developer container while discharging surplus developer so as to suppress degradation in charging performance.

For example, a developing device is known that includes a transport screw (first transporting portion) for transporting developer, a return screw (second transporting portion) arranged on the downstream side of the transport screw with respect to the transport direction of the transport screw, and a discharge screw (third transporting portion) arranged on the upstream side of the return screw with respect to the transport direction of the return screw for transporting the developer toward a discharge port, wherein a disk is provided between the return screw (second transporting portion) and the discharge screw (third transporting portion). The disk serves as a circular wall to push back a large part of the developer moving toward the discharge port so that no excessive developer is discharged through the discharge port.

SUMMARY

According to one aspect of the present disclosure, a developing device has a developer container, a first stirring/transporting member, a second stirring/transporting member, a developer carrying member, a developer supply port, a developer discharge port, a regulating portion, and a height adjustment opening. The developer container has a plurality of transport chambers including a first transport chamber and a second transport chamber arranged parallel to each other, a partition partitioning between the first transport chamber and the second transport chamber, and communication portions through which the first and second transport chambers communicate with each other at opposite side end parts of the partition in the longitudinal direction thereof, and stores two-component developer containing magnetic carrier and toner. The first stirring/transporting member is composed of a rotary shaft and a first transport blade formed on the circumferential surface of the rotary shaft, and stirs and transports the developer in the first transport chamber in the axial direction of the rotary shaft. The second stirring/transporting member is composed of a rotary shaft and a second transport blade formed on the circumferential surface of the rotary shaft, and stirs and transports the developer in the second transport chamber in the opposite direction to the first stirring/transporting member. The developer carrying member is rotatably supported on the developer container, and carries on the surface thereof the developer in the second transport chamber. Through the developer supply port, the developer is supplied into the developer container. The developer discharge port is arranged in a downstream-side end part of the second transport chamber with respect to the transport direction of the developer in the second transport chamber, and through the developer discharge port, surplus developer in the developer container is discharged. The regulating portion is arranged opposite the developer discharge port on the downstream side of the second transport blade of the second stirring/transporting member with respect to the transport direction of the developer in the second transport chamber, and regulates movement of the developer toward the developer discharge port. The height adjustment opening is formed in the vicinity of the downstream end of the partition with respect to the transport direction of the developer in the second transport chamber, and when the height of the developer in the second transport chamber is equal to or higher than a predetermined height, part of the developer passes through the height adjustment opening and moves to the first transport chamber.

Further features and advantages of the present disclosure will become apparent from the description of embodiments given below.

DETAILED DESCRIPTION

Figure 1:
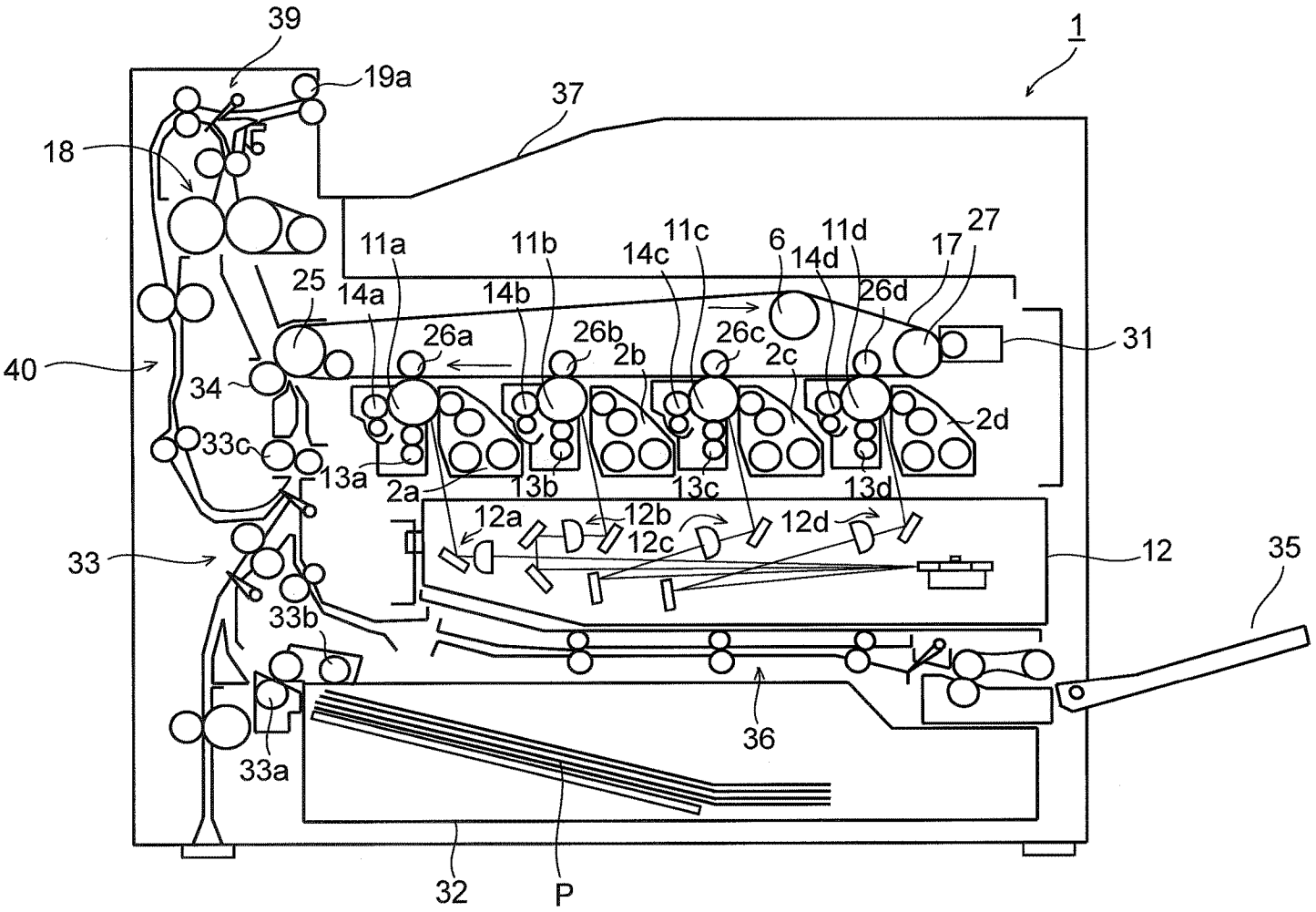
FIG. 1 is a sectional view schematically showing an overall construction of an image forming apparatus 1 incorporating developing devices 2*a* to 2*d* according to the present disclosure.

Hereinafter, an embodiment of the present disclosure will be described with reference to the accompanying drawings. FIG. 1 is a sectional view schematically showing a construction of an image forming apparatus 1 incorporating developing devices 2*a* to 2*d* according to the present disclosure. The image forming apparatus 1 is a tandem-type color printer. Around photosensitive drums 11*a* to 11*d* which are rotatable, there are respectively arranged developing devices 2*a* to 2*d*, an exposure unit 12, charging devices 13*a* to 13*d*, and cleaning devices 14*a* to 14*d*.

The charging devices 13*a* to 13*d* are arranged on the upstream side of the developing devices 2*a* to 2*d* with respect to the rotation direction (the counter-clockwise direction in FIG. 1) of the photosensitive drums 11*a* to 11*d*, and electrostatically charge the surfaces of the photosensitive drums 11*a* to 11*d* uniformly. The exposure unit 12 is for scanning the photosensitive drums 11*a* to 11*d* to expose them to light based on the image data entered in an image input unit (unillustrated) from a personal computer or the like. By laser light shone from the exposure unit 12, electrostatic latent images are formed on the surfaces of the photosensitive drums 11*a* to 11*d*, and these electrostatic latent images are developed into toner images by the developing devices 2*a* to 2*d*.

An intermediate transfer belt 17 is wound, under tension, around a tension roller 6, a driving roller 25, and a following roller 27. The intermediate transfer belt 17 is driven to rotate in the clockwise direction in FIG. 1 by the rotation of the driving roller 25.

Primary transfer rollers 26*a* to 26*d* are arranged opposite the photosensitive drums 11*a* to 11*d* respectively across the intermediate transfer belt 17, and are kept in pressed contact with the intermediate transfer belt 17, thereby forming a primary transfer portion. In the primary transfer portion, as the intermediate transfer belt 17 rotates, the toner images of four colors, namely cyan, magenta, yellow, and black, on the photosensitive drums 11*a* to 11*d* are transferred sequentially to the intermediate transfer belt 17 with predetermined timing. After the transfer, toner left behind on the photosensitive drums 11*a* to 11*d* is removed by cleaning devices 14*a* to 14*d*.

A secondary transfer roller 34 is arranged opposite the driving roller 25 across the intermediate transfer belt 17, and is kept in pressed contact with the intermediate transfer belt 17, thereby forming a secondary transfer portion. In the secondary transfer portion, the toner images on the surface of the intermediate transfer belt 17 are transferred to a sheet P. After the toner images are transferred, a belt cleaning device 31 removes toner left behind on the surface of the intermediate transfer belt 17.

In a lower part of the image forming apparatus 1, a sheet feed cassette 32 is arranged for storing sheets P, and at the right side of the sheet feed cassette 32, a stack tray (manual sheet feed tray) 35 is arranged. A sheet P fed from the sheet feed cassette 32 by a pick-up roller 33*b* and a separating roller 33*a* is transported through a first sheet transport passage 33 to a registration roller pair 33*c*. A sheet P fed from the stack tray 35 is transported through a second sheet transport passage 36 to the registration roller pair 33*c*. The registration roller pair 33*c* transports those sheets P to the secondary transfer portion while adjusting the timing of image formation on the intermediate transfer belt 17 and sheet feeding. To the sheet P transported to the secondary transfer portion, a full color toner image on the intermediate transfer belt 17 is secondarily transferred by the secondary transfer roller 34 to which a transfer bias is applied, and the sheet P is then transported to a fixing portion 18.

The fixing portion 18 includes a fixing belt which is heated by a heat roller, a fixing roller which makes contact with the fixing belt from inside, a pressure roller which is arranged in pressed contact with the fixing roller across the fixing belt, etc. The fixing portion 18 applies heat and pressure to the sheet P having the toner images transferred to it, and thereby achieves fixing. After the toner images are fixed to the sheet P in the fixing portion 18, the sheet P is reversed as necessary in a fourth sheet transport passage 40 so that toner images are secondarily transferred also to the reversed side of the sheet P by the second transfer roller 34 and are then fixed in the fixing portion 18. The sheet P having the toner images fixed to it is discharged through a third sheet transport passage 39 onto a sheet discharging portion 37 by a discharge roller 19*a*.

In the image forming apparatus 1 according to the present disclosure, the driving speed of the apparatus can be switched between two levels according to the thickness and kind of the sheet (recording medium) that is transported. That is, when plain paper is used as the sheet, image formation is performed at an ordinary driving speed (hereinafter, referred to as a full speed mode); when thick paper is used as the sheet, image formation is performed at a speed lower than the ordinary speed (hereinafter, referred to as a reduced-speed mode). With this configuration, when thick paper is used, it is possible to secure a sufficient fixing time to improve image quality.

Figure 2:
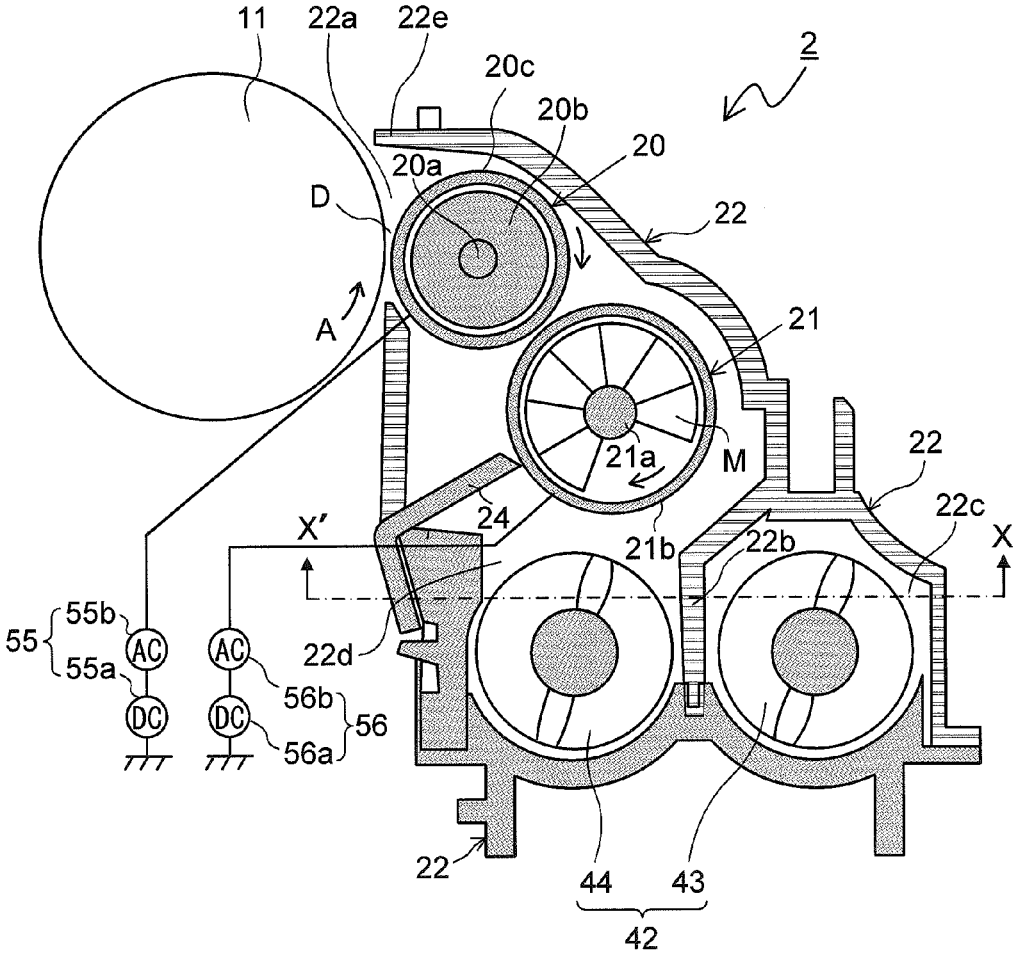
FIG. 2 is a side sectional view of a developing device 2 according to one embodiment of the present disclosure.

FIG. 2 is a sectional plan view showing a structure of a developing device 2 incorporated in the above-described image forming apparatus 1. While the following description deals with the structure and operation of the developing device 2*a* corresponding to the photosensitive drum 11*a* shown in FIG. 1, the structure and operation of the developing devices 2*b* to 2*d* are similar to those of the developing device 2*a*, and therefore no overlapping description will be repeated. Moreover, the suffixes "a" to "d" distinguishing the developing devices and the photosensitive members for different colors will be omitted.

As shown in FIG. 2, the developing device 2 is composed of a developing roller 20, a magnetic roller 21, a regulating blade 24, a stirring member 42, a developer container 22, etc.

The developer container 22 forms the housing of the developing device 2, and is divided, in a lower part of it, into a first transport chamber 22*c* and a second transport chamber 22*d* by a partition 22*b*. In the first and second transport chambers 22*c* and 22*d*, two-component developer (hereinafter, also referred to simply as developer) containing magnetic carrier and toner (here, positively charged toner) is stored. The developer container 22 rotatably holds the stirring member 42, the magnetic roller 21, and the developing roller 20. In the developer container 22, an opening 22*a* is formed through which the developing roller 20 is exposed toward the photosensitive drum 11.

The developing roller 20 is arranged opposite the photosensitive drum 11 across a predetermined interval, on the right side of the photosensitive drum 11. The developing roller 20 forms, at a position opposite and close to the photosensitive drum 11, a developing region D where toner is fed to the photosensitive drum 11. The magnetic roller 21 is arranged opposite the developing roller 20 across a predetermined interval, obliquely on the lower right side of the developing roller 20. The magnetic roller 21 feeds toner to the developing roller 20 at a position opposite and close to the developing roller 20. The stirring member 42 is arranged largely under the magnetic roller 21. The regulating blade 24 is fixedly held on the developer container 22, obliquely on the lower left side of the magnetic roller 21.

The stirring member 42 is composed of two spirals, namely a first spiral 43 and a second spiral 44. The second spiral 44 is arranged under the magnetic roller 21, in the second transport chamber 22*d*. The first spiral 43 is arranged next to, on the right side of, the second spiral 44, in the first transport chamber 22*c*.

The first and second spirals 43 and 44, while stirring developer, electrostatically charge the toner contained in the developer up to a predetermined level. This allows the toner to be held on the carrier. Communication portions (unillustrated) are provided in opposite longitudinal-direction (the direction perpendicular to the plane of FIG. 2) end parts of the partition 22*b* that partitions between the first transport chamber 22*c* and the second transport chamber 22*d*. As the first spiral 43 rotates, the charged developer is transported to the second spiral 44 via one of the communication portions arranged in the partition 22*b* so that the developer circulates through the first transport chamber 22*c* and the second transport chamber 22*d*. Then, the developer is fed from the second spiral 44 to the magnetic roller 21.

The magnetic roller 21 includes a roller shaft 21*a*, a magnetic pole member M, and a non-magnetic sleeve 21*b* formed of a non-magnetic material. The magnetic roller 21 carries the developer fed from the stirring member 42, and feeds, out of the developer carried, the toner alone to the developing roller 20. The magnetic pole member M has a plurality of magnets, which are each formed to have a fan-shaped section and which have on their peripheral parts different magnetic polarities from one to the next, arranged alternately. The magnetic pole member M is adhered or otherwise fixed to the roller shaft 21*a*. The roller shaft 21*a* is unrotatably supported on the developer container 22, in the non-magnetic sleeve 21*b*, with a predetermined interval between the magnetic pole member M and the non-magnetic sleeve 21*b*. The non-magnetic sleeve 21*b* rotates in the same direction (the clockwise direction in FIG. 2) as the developing roller 20 by the action of a driving mechanism comprising a motor and gears, of which none is illustrated. To the non-magnetic sleeve 21*b*, a bias 56 having an AC voltage 56*b* superimposed on a DC voltage 56*a* is applied. On the surface of the non-magnetic sleeve 21*b*, the charged developer is carried in the form of a magnetic brush by the magnetic force of the magnetic pole member M, and the magnetic brush is adjusted to have a predetermined height by the regulating blade 24.

As the non-magnetic sleeve 21*b* rotates, the magnetic brush is transported while being carried on the surface of the non-magnetic sleeve 21*b* by the magnetic pole member M. When the magnetic brush makes contact with the developing roller 20, the toner alone out of the magnetic brush is fed to the developing roller 20 according to the bias 56 applied to the non-magnetic sleeve 21*b*.

The developing roller 20 is composed of a fixed shaft 20*a*, a magnetic pole member 20*b*, a developing sleeve 20*c* formed in a cylindrical shape out of a non-magnetic metal material, etc.

The fixed shaft 20*a* is unrotatably supported on the developer container 22. Around the fixed shaft 20*a*, the developing sleeve 20*c* is rotatably held. Moreover, to the fixed shaft 20*a*, the magnetic pole member 20*b* comprising a magnet is adhered or otherwise fixed at a position opposite the magnetic roller 21, at a predetermined distance from the developing sleeve 20*c*. The developing sleeve 20*c* rotates in the direction indicated by an arrow in FIG. 2 (the clockwise direction) by the action of a driving mechanism comprising a motor and gears, of which none is illustrated. To the developing sleeve 20*c*, a developing bias 55 having an AC voltage 55*b* superimposed on a DC voltage 55*a* is applied.

As the developing sleeve 20*c* to which the developing bias 55 is applied rotates in the clockwise direction in FIG. 2, in the developing region D, due to the potential difference between the developing bias and the exposed part of the photosensitive drum, toner carried on the surface of the developing sleeve 20*c* flies to the photosensitive drum 11. The flying toner attaches, sequentially, to the exposed part on the photosensitive drum 11 rotating in the direction indicated by arrow A (the counter-clockwise direction), and thus the electrostatic latent image on the photosensitive drum 11 is developed.

Figure 3:
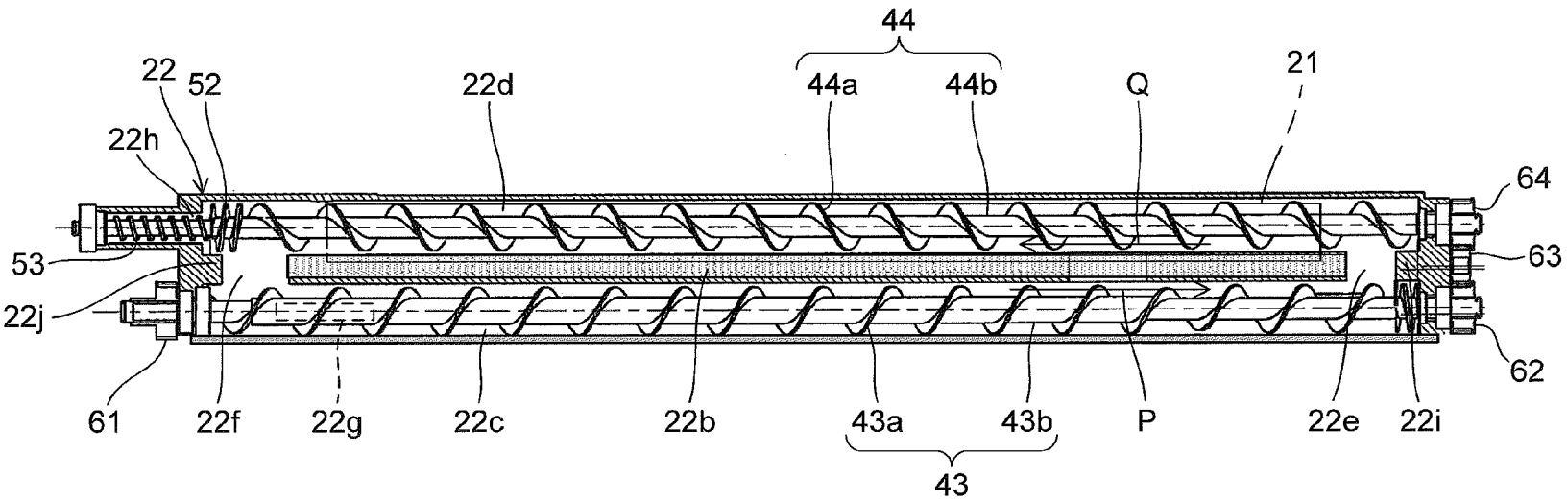
FIG. 3 is a sectional plan view of a stirring portion of the developing device 2 according to the embodiment.

Now, a stirring portion in the developing device 2 will be described in detail with reference to FIG. 3. FIG. 3 is a sectional plan view (as taken across line X-X' in FIG. 2) of the stirring portion in the developing device 2.

In the developer container 22, as described previously, there are formed a first transport chamber 22*c*, a second transport chamber 22*d*, a partition 22*b*, an upstream-side communication portion 22*e*, and a downstream-side communication portion 22*f*. In the developer container 22, there are further formed a developer supply port 22*g*, a developer discharge port 22*h*, an upstream-side wall portion 22*i*, and a downstream-side wall portion 22*j*. With respect to the first transport chamber 22*c*, the left side in FIG. 3 is the upstream side and the right side in FIG. 3 is the downstream side; with respect to the second transport chamber 22*d*, the right side in FIG. 3 is the upstream side and the left side in FIG. 3 is the downstream side. Thus, the communication portions and the side wall portions are distinguished between the upstream-side and downstream-side ones relative to the second transport chamber 22*d*.

The partition 22*b* extends in the longitudinal direction of the developer container 22 to separate the first transport chamber 22*c* and the second transport chamber 22*d* parallel to each other. On one hand, the right side end part of the partition 22*b* in the longitudinal direction forms the upstream-side communication portion 22*e* together with the inner wall part of the upstream-side wall portion 22*i*. On the other hand, the left side end part of the partition 22*b* in the longitudinal direction forms the downstream-side communication portion 22*f* together with the inner wall part of the downstream-side wall portion 22*j*. Thus, developer can circulate through the first transport chamber 22*c*, the upstream-side communication portion 22*e*, the second transport chamber 22*d*, and the downstream-side communication portion 22*f*.

The developer supply port 22*g* is a port through which new toner and carrier are supplied from a developer supply container (unillustrated) provided over the developer container 22 into the developer container 22. The developer supply port 22*g* is arranged on the upstream side (the left side in FIG. 3) of the first transport chamber 22*c*.

The developer discharge port 22*h* is a port through which surplus developer in the first and second transport chambers 22*c* and 22*d* resulting from supply of new developer is discharged. The developer discharge port 22*h* is arranged continuous with the second transport chamber 22*d* in the longitudinal direction on the downstream side of the second transport chamber 22*d*.

In the first transport chamber 22*c*, the first spiral 43 is arranged, and in the second transport chamber 22*d*, the second spiral 44 is arranged.

The first spiral 43 has a rotary shaft 43*b* and a first helical blade 43*a* provided integrally with the rotary shaft 43*b* and formed in a helical shape with a predetermined pitch in the axial direction of the rotary shaft 43*b*. The first helical blade 43*a* extends up to opposite side end parts of the first transport chamber 22*c* in the longitudinal direction, and is arranged so as to face the upstream-side and downstream-side communication portions 22*e* and 22*f*. The rotary shaft 43*b* is rotatably supported on the upstream-side wall portion 22*i* and the downstream-side wall portion 22*j* of the developer container 22.

The second spiral 44 has a rotary shaft 44*b* and a second helical blade 44*a* provided integrally with the rotary shaft 44*b* and formed in a helical shape spiraling in the opposite direction (in the opposite phase) to the first helical blade 43*a* with the same pitch as the first helical blade 43*a* in the axial direction of the rotary shaft 44*b*. The second helical blade 44*a* has a length larger than that of the magnetic roller 21 in the axial direction, and is arranged so as to extend up to a position facing the upstream-side communication portion 22*e*. The rotary shaft 44*b* is arranged parallel to the rotary shaft 43*b* and is rotatably supported on the upstream-side wall portion 22*i* and the downstream-side wall portion 22*j* of the developer container 22.

On the rotary shaft 44*b*, a regulating portion 52 and a discharge blade 53 are integrally arranged together with the second helical blade 44*a*.

The regulating portion 52 blocks the developer transported to the downstream side inside the second transport chamber 22*d* and transports the developer to the developer discharge port 22*h* when the amount of developer is equal to or higher than a predetermined amount. The regulating portion 52 comprises a helical blade (regulating blade) provided on the rotary shaft 44*b*, and is formed in a helical shape spiraling in the opposite direction (in the opposite phase) to the second helical blade 44*a*. The regulating portion 52 is configured to have substantially the same outer diameter as, but a smaller pitch than, the second helical blade 44*a*. The circumferential portion of the regulating portion 52 has a predetermined gap (clearance) secured from the inner wall portion (the downstream-side wall portion 22*j*) of the developer container 22. The surplus developer is discharged through the gap.

The rotary shaft 44*b* extends into the developer discharge port 22*h*. On the rotary shaft 44*b* in the developer discharge port 22*h*, the discharge blade 53 is provided. The discharge blade 53 comprises a blade spiraling in the same direction as the second helical blade 44*a*, but has a smaller pitch and a smaller blade circumference than those of the second helical blade 44*a*. Thus, as the rotary shaft 44*b* rotates, the discharge blade 53 also rotates so that the surplus developer transported into the developer discharge port 22*h* over the regulating portion 52 is transported to the left side in FIG. 3 to be discharged out from the developer container 22. The discharge blade 53, the regulating portion 52, and the second helical blade 44*a* are formed integrally with the rotary shaft 44*b* out of synthetic resin.

On an outer wall of the developer container 22, gears 61 to 64 are arranged. The gears 61 and 62 are fixed on the rotary shaft 43*b*, the gear 64 is fixed on the rotary shaft 44*b*, and the gear 63 is rotatably held on the developer container 22 to mesh with the gears 62 and 64.

During development, during which no new developer is supplied, as the gear 61 rotates by the action of a driving source such as a motor, the first helical blade 43*a* rotates together with the rotary shaft 43*b*. By the first helical blade 43*a*, developer in the first transport chamber 22*c* is transported in the direction indicated by arrow P, and the developer is then transported through the upstream-side communication portion 22*e* into the second transport chamber 22*d*. Moreover, as the second helical blade 44*a* rotates together with the rotary shaft 44*b* which follows the gear 64, by the second helical blade 44*a*, the developer in the second transport chamber 22*d* is transported in the direction indicated by arrow Q. Thus, the developer is, while greatly varying its height, transported from the first transport chamber 22*c* through the upstream-side communication portion 22*e* into the second transport chamber 22*d*, and the developer is then, without going over the regulating portion 52, transported through the downstream-side communication portion 22*f* to the first transport chamber 22*c*.

In this way, developer circulates through, while being stirred, the first transport chamber 22*c*, the upstream-side communication portion 22*e*, the second transport chamber 22*d*, and the downstream-side communication portion 22*f*, and the stirred developer is fed to the magnetic roller 21.

Now, how developer is supplied through the developer supply port 22*g* will be described. As toner is consumed in development, developer containing toner and carrier is supplied through the developer supply port 22*g* into the first transport chamber 22*c*.

The supplied developer is, as during development, transported in the direction indicated by arrow P inside the first transport chamber 22*c* by the first helical blade 43*a*, and the developer is then transported through the upstream-side communication portion 22*e* into the second transport chamber 22*d*. Moreover, by the second helical blade 44*a*, the developer in the second transport chamber 22*d* is transported in the direction indicated by arrow Q. As the regulating portion 52 rotates together with the rotary shaft 44*b*, a transporting force in the direction opposite to the developer transport direction ascribable to the second helical blade 44*a* is applied to the developer by the regulating portion 52. The developer increases its height by being blocked by the regulating portion 52, and the surplus developer is discharged over the regulating portion 52 via the developer discharge port 22*h* out of the developer container 22.

Figure 4:
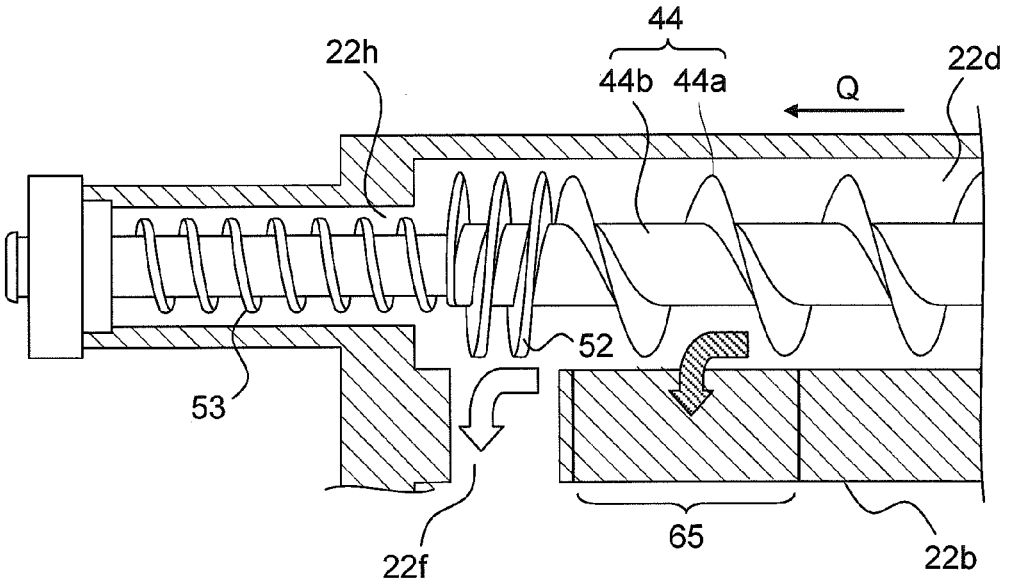
FIG. 4 is a sectional plan view of and around a developer discharge port 22*h* in the developing device 2 according to the embodiment.
Figure 5:
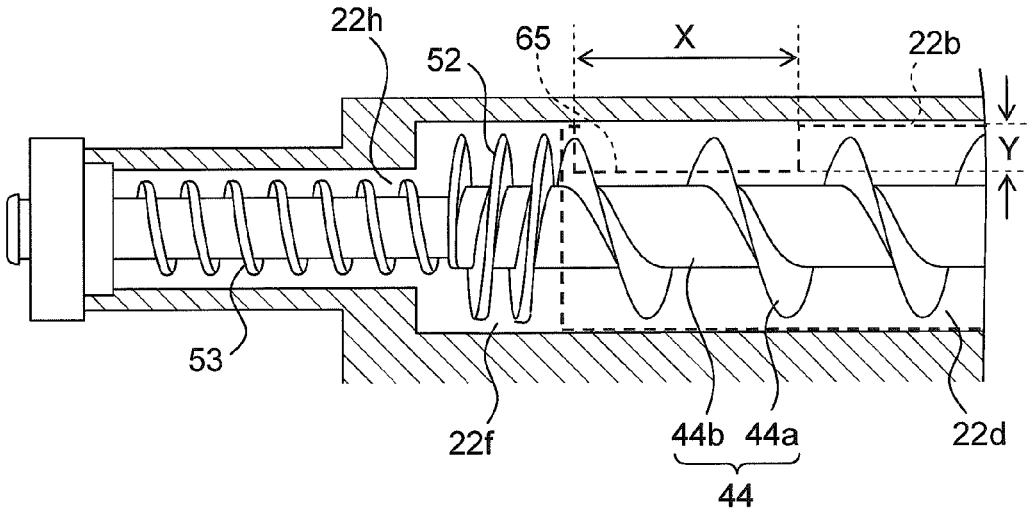
FIG. 5 is a side sectional view of and around the developer discharge port 22*h* in the developing device 2 according to the embodiment.

FIG. 4 is a sectional plan view of and around the developer discharge port 22*h* in the developing device 2 according to the embodiment, and FIG. 5 is a side sectional view of and around the developer discharge port 22*h*. As shown in FIGS. 4 and 5, the regulating portion 52 is composed of two turns (two phases) of regulating blades spiraling in the opposite direction (the opposite phase) to the second helical blade 44*a*. In the partition 22*b*, a height adjustment opening 65 is formed at a position facing the downstream end of the second helical blade 44*a* with respect to the transport direction of developer inside the second transport chamber 22*d*.

As described above, switching between the full speed mode and the reduced-speed mode changes the rotation speed of the first spiral 43 and the second spiral 44 in the developing device 2, thus abruptly changing the transport speed of developer inside the developer container 22. As a result, uneven developer distribution occurs in the developer container 22. Specifically, in the full speed mode, as a result of the rotation speed of the first and second spirals 43 and 44 being high, the height of the developer transported inside the second transport chamber 22*d* by the second helical blade 44*a* is larger than that in the reduced-speed mode.

In the developing device 2 according to the embodiment, uneven developer distribution inside the developer container 22 can be suppressed by the height adjustment opening 65 formed in the partition 22*b*. That is, in the full speed mode, owing to the large height of the developer transported inside the second transport chamber 22*d*, the developer is transported through the downstream-side communication portion 22*f* and the height adjustment opening 65 (as indicated by a hollow arrow and a hatched arrow in FIG. 4) to the first transport chamber 22*c*.

On the other hand, in the reduced-speed mode, owing to the small height of the developer transported inside the second transport chamber 22*d*, the developer is transported through the downstream-side communication portion 22*f* alone (as indicated by the white arrow in FIG. 4) to the first transport chamber 22*c*. This helps reduce the amount of developer moving to the regulating portion 52 in the full speed mode in which the height of developer is large, and thereby reduce the difference between the amounts (discharge amounts) of developer transported over the regulating portion 52 to the developer discharge port 22*h* in the full speed mode and in the reduced-speed mode respectively.

As described above, even when the height of the developer inside the developer container 22 varies, no excessive developer is transported over the regulating portion 52 to the developer discharge port 22*h*, and it is thus possible to stabilize the amount of developer discharged through the developer discharge port 22*h*. Thus, the stable weight of developer inside the developer container 22 can be kept substantially constant when the process speed of the image forming apparatus 1 is changed. Moreover, the stable weight of developer inside the developer container 22 can be kept substantially constant when a developing device 2 with the same specifications is incorporated in a plurality of kinds of image forming apparatuses 1 having different process speeds.

In this embodiment, the opening dimension X of the height adjustment opening 65 in the developer transport direction (the horizontal direction) equals a range from the most downstream end of the second helical blade 44*a* to an end part of the circumferential surface (developer carriable region) of the magnetic roller 21 facing the developable region of the developing roller 20 (the region where toner can be fed to the image forming region of the photosensitive drums 11*a* to 11*d*). This permits the developer having an increased height inside the second transport chamber 22*d* to be efficiently transported into the first transport chamber 22*c* and to be stably fed to the developer carriable region of the magnetic roller 21 facing the developable region of the developing roller 20.

The opening dimension Y of the height adjustment opening 65 in the vertical direction equals a range from the top end of the partition 22*b* to the position of the top surface of the developer present in the reduced-speed mode. This allows the height of the developer inside the second transport chamber 22*d* in the full speed mode to be substantially the same as that in the reduced-speed mode.

Figure 6:
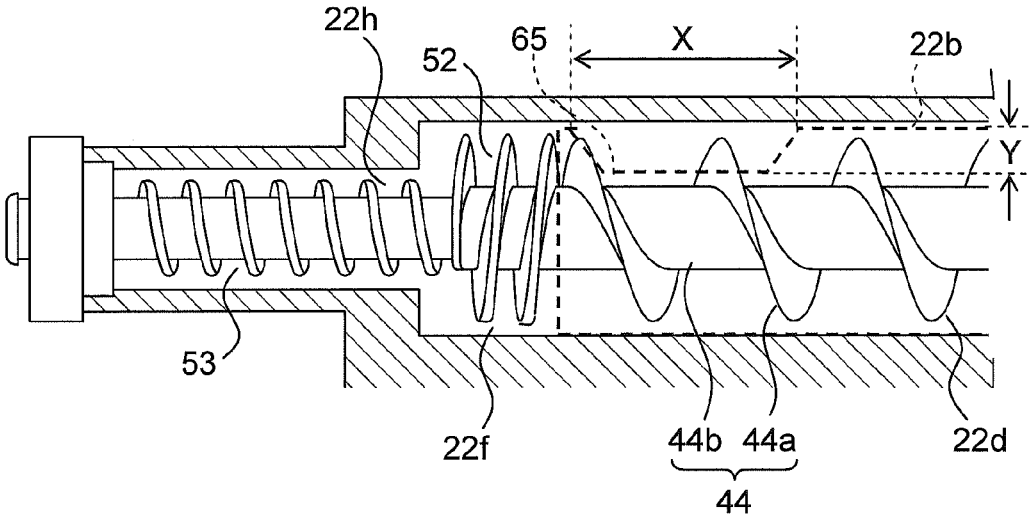
FIG. 6 is a side sectional view of and around the developer discharge port 22*h* in the developing device 2 according to the embodiment, showing a modified example in which a height adjustment opening 65 in an inverted trapezoidal shape as seen in a side view is provided in a partition 22*b;*
Figure 7:
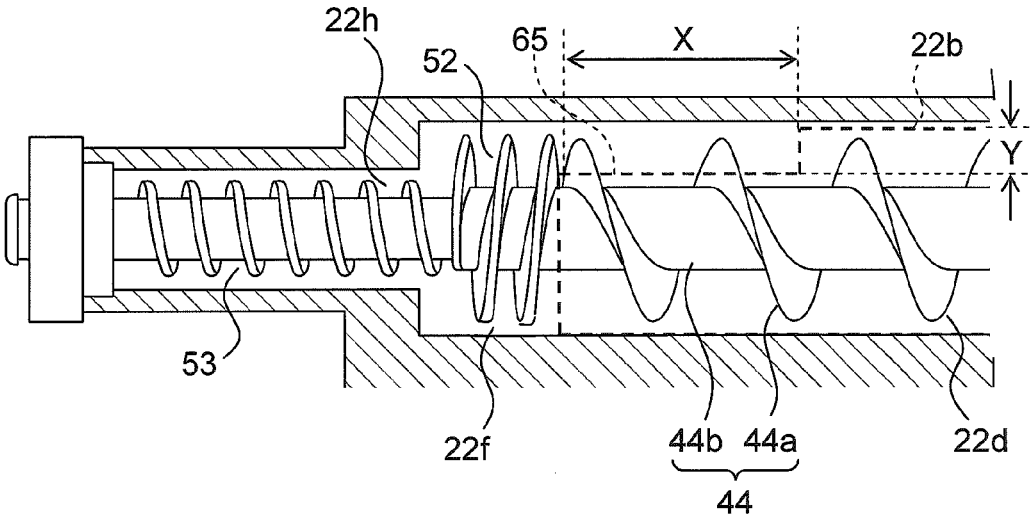
FIG. 7 is a side sectional view of and around the developer discharge port 22*h* in the developing device 2 according to the embodiment, showing a modified example in which a step-shaped height adjustment opening 65 is provided so as to communicate with the downstream-side communication portion 22*h*.

It is not always necessary to form the height adjustment opening 65 over the entire range of the above-described opening dimensions X and Y, and thus the height adjustment opening 65 may be an arbitrary size within the range of the opening dimensions X and Y. That is, the maximum opening dimension of the height adjustment opening 65 in the horizontal direction equals X, and the maximum opening dimension of the height adjustment opening 65 in the vertical direction equals Y. The shape of the height adjustment opening 65 is not limited to a rectangular shape; for example, the height adjustment opening 65 may be an inverted trapezoidal shape as shown in FIG. 6 or may be step shaped such that a downstream-side end part of the height adjustment opening 65 communicates with the downstream-side communication portion 22*f* as shown in FIG. 7.

The embodiment described above is in no way meant to limit the present disclosure, which thus allows for many modifications and variations within the spirit of the present disclosure. For example, the present disclosure is not limited to developing devices provided with a magnetic roller 21 and a developing roller 20 like those shown in FIG. 2; it is applicable to various developing devices that use two-component developer containing toner and carrier. For example, the present disclosure is applicable exactly in the same manner also to developing devices adopting a system in which toner in a magnetic brush formed on a magnetic roller (developer carrying member) is attached to an electrostatic latent image on a photosensitive member.

Although the above-described embodiment has dealt with a two-shaft transport type developing device provided with a first transport chamber 22*c* and a second transport chamber 22*d* arranged parallel to each other as developer circulation passages in a developer container 22, the present disclosure is applicable also to a three-shaft transport type developing device provided additionally with a collection transport chamber in which developer removed from a magnetic roller 21 is collected to be fed back to the second transport chamber 22*d*.

Although in the above-described embodiment, a configuration is adopted where a regulating portion 52 comprises a helical blade spiraling in the opposite phase to a second helical blade 44*a*, this is in no way meant to limit the present disclosure; as the regulating portion 52, a disk having a larger size than the opening of a developer discharge port 22*h* may be formed on a rotary shaft 44*b*, and may be arranged next to the developer discharge port 22*h*. Although in the above-described embodiment, use is made of a first stirring screw 43 having a first helical blade 43*a* continuously arranged on the circumferential surface of a rotary shaft 43*b* and a second stirring screw 44 having a second helical blade 44*a* continuously arranged on the circumferential surface of a rotary shaft 44*b*, the transport blade that transports developer is not limited to a helical blade; instead, use may also be made of, for example, a stirring/transporting member having a plurality of semicircular disks (circular disks divided in halves) alternatively arranged with a predetermined inclination angle on the circumferential surfaces of the rotary shafts 43*b* and 44*b*.

The present disclosure is applicable, not only to tandem-type color printers like the one shown in FIG. 1, but to various image forming apparatuses adopting a two-component developing system, such as digital and analog monochrome copiers, monochrome printers, color copiers, and facsimile machines. Below, by way of practical examples, the effect of the present disclosure will be described more specifically.

PRACTICAL EXAMPLES

With a developing device 2 as shown in FIG. 2, experiments were conducted to see how the stable weight of developer inside the developer container 22 varied as the transport speed of developer was varied. The experiments were performed with respect to the image forming portion for cyan that included the photosensitive drum 11*d* and the developing device 2*d*.

In the experiments, as shown in FIGS. 4 and 5, a developing device 2 in which a rectangular height adjustment opening 65 was provided in the partition 22*b* with an opening dimension X of 15 mm in the transport direction and an opening dimension Y of 3.5 mm in the vertical direction was taken as a practical example of the present disclosure; a developing device 2 which had the same structure as the practical example of the present disclosure except that no height adjustment opening 65 was provided was taken as a comparative example. The developing devices 2 according to the present disclosure and the comparative example both employed a second spiral 44 that had a second helical blade 44*a* with an outer diameter of 14 mm and that had formed on it a regulating portion 52 composed of two turns of reverse helical blades with an outer diameter of 11 mm spiraling in the opposite direction to the second helical blade 44*a*. The second spiral 44 also had formed on it a discharge blade 53 with an outer diameter of 8 mm spiraling in the same direction as the second helical blade 44*a*.

The developer containers 22 (the first and second transport chambers 22*c* and 22*d*) in the developing devices 2 according to the present disclosure and the comparative example were each charged with 250 g of two-component developer containing positively charged toner having an average particle diameter of 6.7 μm and ferrite carrier. This amount was a predetermined amount with no surplus developer stored in the developer container 22. The toner concentration (the weight ratio of toner to carrier, T/C) in the developer was 8%. Then, with the developing devices 2 driven, measurements were taken of the amounts (stable weights) of the developer present while the rotation rate of the first and second spiral 43 and 44 was increased stepwise. The FIG. 8 shows the results.

Figure 8:
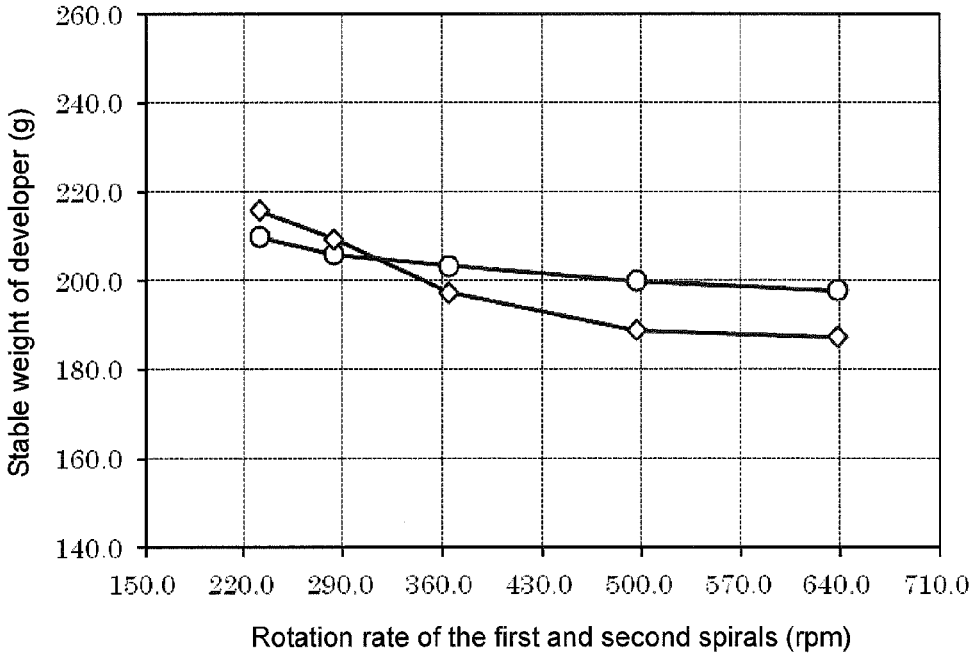
FIG. 8 is a diagram comparing the relationship of the developer transport speed with the stable weight of developer inside the developer container 22 between two examples, namely one including a developing device 2 (present disclosure) provided with a height adjustment opening 65 and another including a developing device 2 (comparative example) provided with no height adjustment opening 65.

As will be clear from FIG. 8, in the developing device 2 according to the present disclosure (the data series indicated by hollow circular symbols in FIG. 8), variation in the stable weight of developer in the developer container 22 was within 10 g as the rotation rate of the first and second spirals 43 and 44 was varied from 220 rpm to 640 rpm.

By contrast, in the developing device 2 according to the comparative example (the data series indicated by hollow rhombic symbols in FIG. 8), variation in the stable weight of developer in the developer container 22 increased to 30 g as the rotation rate of the first and second spirals 43 and 44 was varied from 220 rpm to 640 rpm.

The above results confirm that in the developing device 2 according to the present disclosure, where the height adjustment opening 65 is provided in the partition 22*b*, as compared with the developing device 2 according to the comparative example, where no height adjustment opening 65 is provided, the stable weight of developer varies quite stably irrespective of the stirring speed. Thus, by use of the developing device according to the present disclosure, it is possible to obtain stabilized developing performance and also to effectively suppress image defects and unnecessary discharge of developer.

The present disclosure finds application in developing devices incorporated in image forming apparatuses exploiting electrophotography, such as copiers, printers, facsimile machines, multifunction peripherals thereof, etc., and in image forming apparatuses provided with such developing devices. In particular, the present disclosure finds application in developing devices which can be replenished with new two-component developer containing magnetic carrier and toner and meanwhile discharge surplus developer, and in image forming apparatuses provided with such developing devices.

What is claimed is:

1. A developing device comprising:

a developer container having a plurality of transport chambers including a first transport chamber and a second transport chamber arranged parallel to each other, a partition partitioning between the first transport chamber and the second transport chamber, and communication portions through which the first and second transport chambers communicate with each other at opposite side end parts of the partition in a longitudinal direction thereof, the developer container storing two-component developer containing magnetic carrier and toner;

a first stirring/transporting member composed of a rotary shaft and a first transport blade formed on a circumferential surface of the rotary shaft, the first stirring/transporting member stirring and transporting the developer in the first transport chamber in an axial direction of the rotary shaft;

a second stirring/transporting member composed of a rotary shaft and a second transport blade formed on a circumferential surface of the rotary shaft, the second stirring/transporting member stirring and transporting the developer in the second transport chamber in an opposite direction to the first stirring member;

a developer carrying member rotatably supported on the developer container, the developer carrying member carrying on a surface thereof the developer in the second transport chamber;

a developer supply port through which the developer is supplied into the developer container;

a developer discharge port which is arranged in a downstream-side end part of the second transport chamber with respect to a transport direction of the developer in the second transport chamber and through which surplus developer in the developer container is discharged;

a regulating portion arranged opposite the developer discharge port on a downstream side of the second transport blade of the second stirring/transporting member with respect to the transport direction of the developer in the second transport chamber, the regulating portion regulating movement of the developer toward the developer discharge port; and a height adjustment opening which is formed in a vicinity of a downstream end of the partition with respect to the transport direction of the developer in the second transport chamber and through which part of the developer passes and moves to the first transport chamber when a height of the developer in the second transport chamber is equal to or higher than a predetermined height, wherein a bottom edge of the height adjustment opening is located below a top end part of the second transport blade of the second stirring/transporting member, above a top surface of the rotary shaft of the second stirring/transporting member.

2. The developing device of claim 1, wherein a rotation speed of the first and second stirring/transporting members can be switched among a plurality of levels, when the rotation speed of the first and second stirring/transporting members is lower than a predetermined speed, the developer in the second transport chamber is transported through the communication portions alone to the first transport chamber, and when the rotation speed of the first and second stirring/transporting members is equal to or higher than a predetermined speed, the developer in the second transport chamber is transported through the communication portions and the height adjustment opening to the first transport chamber.

3. The developing device of claim 2, wherein a maximum opening dimension of the height adjustment opening in a horizontal direction equals a range from a most downstream end of the partition to an end part of a developer carriable region of the developer carrying member.

4. The developing device of claim 2, wherein a maximum opening dimension of the height adjustment opening in a vertical direction equals a range from a top end of the partition to a position of a top surface of developer present in the developer container when the rotation speed of the first and second stirring/transporting members is lowest and in addition the developer container is charged with a predetermined amount of developer with no surplus developer included.

5. An image forming apparatus comprising the developing device of claim 1, wherein the image forming apparatus allows choice between a full speed mode in which image formation is performed at a predetermined process speed and a reduced-speed mode in which image formation is performed at a lower process speed than in the full speed mode.

* * * * *